US006089147A

United States Patent [19]

Rodriguez et al.

[11] Patent Number: 6,089,147

[45] Date of Patent: Jul. 18, 2000

[54] PROCESS FOR PRESSING MATERIALS

[75] Inventors: Lorenzo Rodriguez, Zola-Predosa; Maurizio Cini, Bologna; Cristina Cavallari, Bologna; Giuseppe Motta, Bologna, all of Italy

[73] Assignee: Saitec s.r.l., Castel Guelfo, Italy

[21] Appl. No.: 08/930,290

[22] PCT Filed: Jan. 24, 1997

[86] PCT No.: PCT/IT97/00018

§ 371 Date: Sep. 30, 1997

§ 102(e) Date: Sep. 30, 1997

[87] PCT Pub. No.: WO97/27994

PCT Pub. Date: Aug. 7, 1997

[30] Foreign Application Priority Data

Jan. 31, 1996 [IT] Italy ..... BO96A0044

[51] Int. Cl.[7] ..... B30B 9/06; B30B 11/26

[52] U.S. Cl. ..... 100/37; 99/495; 100/39; 100/41; 100/70 R; 100/106; 100/126; 100/906; 204/157.42; 204/553; 265/443; 425/174.2; 426/478; 426/489

[58] Field of Search ..... 100/35, 37, 39, 100/41, 70 R, 98 R, 104, 106, 126, 903, 906; 99/451, 495; 204/157.15, 157.42, 157.62, 545, 553, 648–650; 264/443; 425/174.2; 426/238, 245, 246, 478, 489

[56] References Cited

U.S. PATENT DOCUMENTS

| | | | |
|---|---|---|---|
| 2,714,349 | 8/1955 | Johnston | 100/106 |
| 3,542,600 | 11/1970 | Pohlmann | 204/157.42 |
| 3,611,951 | 10/1971 | Sloan | 100/98 R |
| 4,304,656 | 12/1981 | Lee . | |
| 4,732,331 | 3/1988 | Hughes | 100/98 R |
| 5,049,248 | 9/1991 | Muralidhara et al. | 204/545 |
| 5,124,126 | 6/1992 | Ripp | 100/131 |
| 5,160,593 | 11/1992 | Candor | 204/553 |

FOREIGN PATENT DOCUMENTS

| | | | |
|---|---|---|---|
| 054 005 | 6/1982 | European Pat. Off. . | |
| 1072918 | 1/1960 | Germany | 100/70 R |
| 2 047 398 | 4/1971 | Germany . | |
| 125137 | 5/1959 | Russian Federation | 100/106 |
| 89/02820 | 4/1989 | WIPO | 100/70 R |

OTHER PUBLICATIONS

Patent Abstract of Japan, vol. 005, No. 022 (M–054), Feb. 10, 1981, JP 55–149800.

Patent Abstract of Japan, vol. 006, No. 040 (C–094), Mar. 12, 1982, JP 56–158111.

Patent Abstract of Japan, vol. 005, No. 004 (C–038), Jan. 13, 1981, JP 55–134619.

*Primary Examiner*—Stephen F. Gerrity
*Attorney, Agent, or Firm*—Pillsbury Madison & Sutro LLP

[57] ABSTRACT

A process is disclosed for pressing a material selected from materials of vegetable and animal origin. The process includes the steps of mechanically compressing the material of vegetable or animal origin while simultaneously vibrating the material at an ultrasonic frequency. The ultrasonic frequency going through the material modifies the material's internal state so as to considerably reduce resistance offered by the material to mechanical compression.

17 Claims, 1 Drawing Sheet

PROCESS FOR PRESSING MATERIALS

This application is the national phase of international application PCT/IT97/00018 filed Jan. 24, 1997

DESCRIPTION

1. Technical Field

The present invention relates to a process and apparatus for pressing materials.

The invention relates in particular, but without restricting the scope of the inventive concept, to the pressing of materials of vegetable or animal origin in order to extract the juices and to the pressing of materials subject to plastic deformation such as materials extruded to form pellets for zootechnical applications.

2. Background Art

According to known technology, processes for the extraction of substances such as oils or pharmaceutical active ingredients in liquid form or in solvent solutions from the solid materials of vegetable origin containing them include a mechanical pressing stage effected in mechanical or hydraulic presses.

In some cases, the material to be processed, in addition to being mechanically pressed, is also heated by steam and, in other cases still, heating may be substituted by, or combined with, the use of solvents.

Obviously, the characteristic pressure parameters of these processes differ from one material to another. However, one disadvantage of all the processes known to prior art of the type described above is that they require high-intensity compressive forces, applied for considerable lengths of time and resulting in high energy consumption.

Accordingly, the apparatus used to apply the compressive forces with sufficiently high intensity must be very large, having structures that are complex and expensive to make.

Moreover, the use of process fluids such as steam and solvents further increases the complexity of the apparatus because the latter must be equipped with systems to supply the fluids during the process and then to remove them when their action has been completed.

A further disadvantage is that, in some cases, the temperature of the steam and/or of the solvents may adversely affect the properties of the material being processed.

SUMMARY OF THE INVENTION

It is an aim of the present invention to provide a process for pressing materials which overcomes the drawbacks mentioned above. Another aim of the invention is to provide a process that can be advantageously used for materials that are to be subjected to plastic deformation, as in extrusion, for example.

The invention achieves these and other aims by providing a pressing process in which the material is subjected to a mechanical pressing stage combined with an ultrasonic vibration stage. These two stages are carried out at the same time by a sonotrode pressure element that vibrates at an ultrasonic frequency.

The ultrasonic energy which goes through the material during the mechanical pressing stage produces the surprising effect of modifying the internal state of the material so as to considerably reduce the resistance offered by the material to the pressure exerted on it. The mechanical compression of the material therefore requires less force.

Compared to conventional processes, the pressing process achieved by the present invention is much more efficient because it requires much less power. In fact, all other conditions being equal, the process disclosed by the present invention, compared to a pressing process using a conventional press, reduces by two orders of magnitude the compressive force required and the length of time for which the force must be applied.

Another advantage of the invention is that it is effective at ambient temperature and therefore there is practically no deterioration of the material as a result of temperature.

Since the compressive forces are considerably reduced, the apparatus required is much simpler, more economical and longer lasting.

Moreover, no process fluids are required, with obvious advantages in terms of simplicity of construction and operation of the apparatus required to implement the process.

Yet another advantage of the invention is that, if applied to materials subject to plastic deformation, it produces the same degree of deformation at low temperature that conventional processes, under equal conditions of compression, can only achieve at much higher temperatures.

This, besides being more economical in general, is particularly useful when processing temperature-sensitive materials since it totally removes, or at least greatly reduces, the importance of heating as a stage in the process which is particularly critical and expensive.

The present invention also provides an apparatus for pressing materials which implements the process described above.

The characteristics of the invention are laid out in the claims below and the advantages of the disclosure are apparent from the detailed description which follows, with reference to the accompanying drawings, which illustrate preferred embodiments of the invention and in which:

DESCRIPTION OF THE PREFERRED EMBODIMENTS

Figure 1:
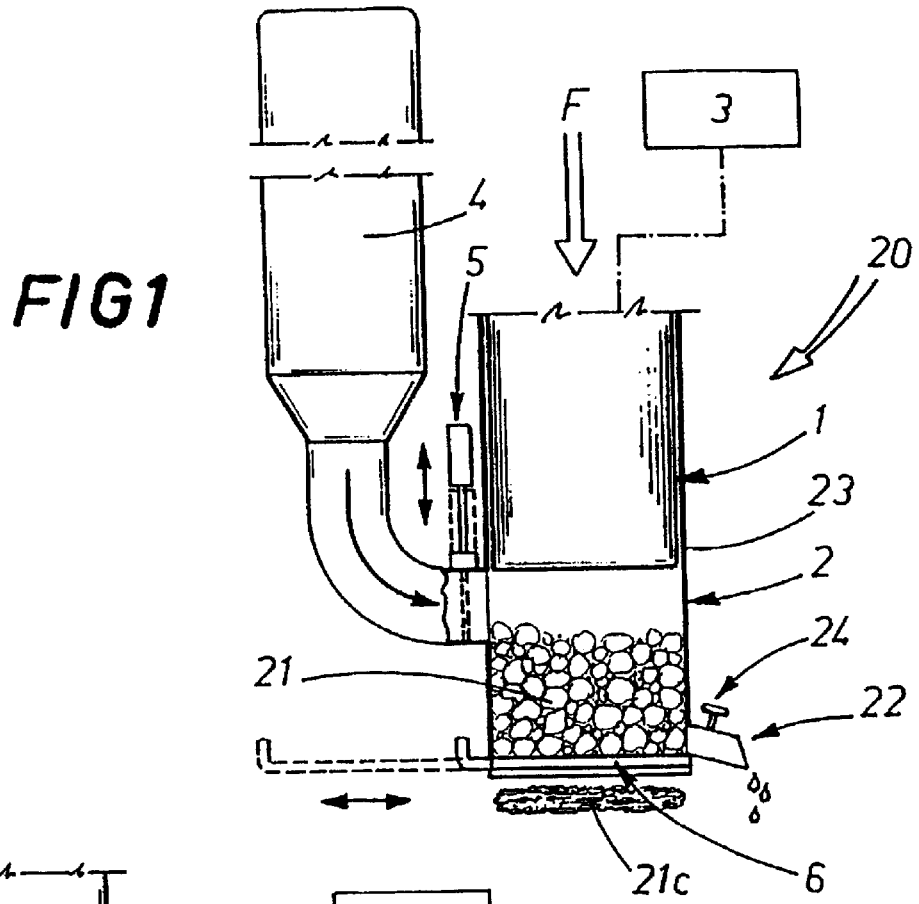
FIGS. 1 and 2 schematically illustrate the apparatus that implements the process in two examples of possible applications.

With reference to FIG. 1, the numeral (20) indicates an apparatus used for pressing materials (21) and basically comprising a sonotrode pressure element (1) consisting of a piston connected to ultrasound generator means (3) and mounted in such a way that it can slide in a cylindrical metal container (2). A force indicated by the arrow (F) in FIGS. 1 and 2 moves the sonotrode pressure element (1) alternately between a backward position, in which it is at rest, and a forward position, in which it is at work on the material (21).

The container (2) is interconnected with a hopper (4) for feeding the material (21) and equipped with a metering valve (5), preferably a gate valve, which opens when the sonotrode pressure element (1) is at the rest position in order to fill the container (2) by gravity feed or by forced feed (for example, using a screw feeder, not illustrated here) and closes when the pressure inside the container (2) is high enough to indicate that the material (21) being compressed is likely to overflow.

The container (2) is also equipped with appropriately shaped means (22), fitted to the bottom end of a side surface (23) of the container (2), designed to tap the juices pressed out of the material (21) and, if necessary, also equipped with valves (24) that are synchronized with the alternating motion of the sonotrode pressure element (1).

At the front of the sonotrode pressure element (1), the container (2) preferably has a wall (6) that can be opened to enable removal of residue material (shown as a broken line and labelled 21*c* in FIG. 1) at the end of the compression process.

The apparatus (20) can be conveniently used to implement a process for pressing a material (21) of vegetable or animal origin in order to squeeze the juices it contains out of it. By way of example, without restricting the scope of the invention, the apparatus (20) can be used in processes for the cold extraction of oils, pharmaceutical active ingredients in liquid form and/or in liquid solvent solutions.

Figure 2:
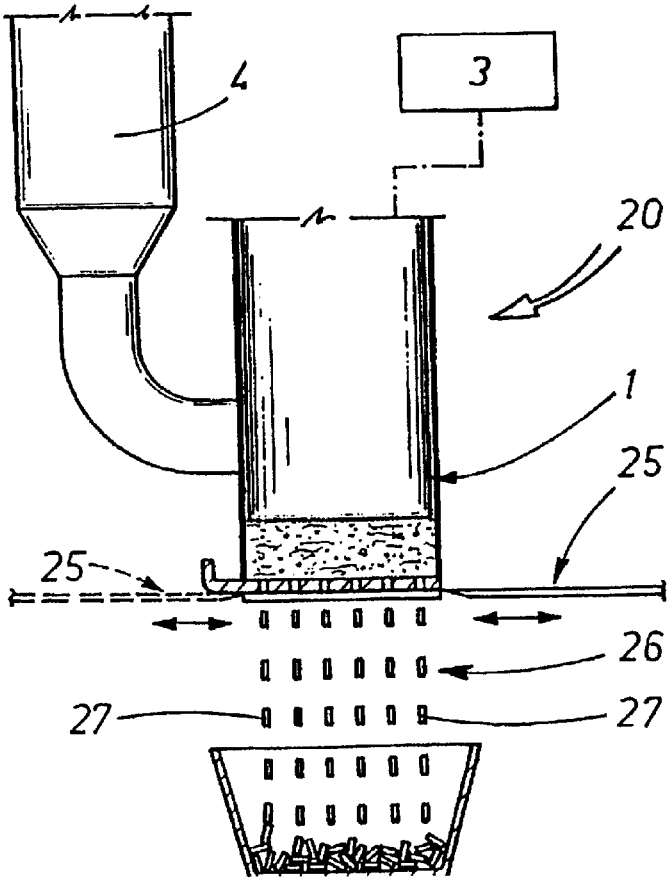

In another embodiment of the apparatus (20), illustrated schematically in FIG. 2, the apparatus (20) can be used for pressing materials (21) subject to plastic deformation such as those used in conventional extrusion processes. In this case, the wall (6) has holes in it to produce rods (26) of compressed material and is equipped with means (25) to cut the rods (26) into pellets (27).

When used for this application, the apparatus has several advantages over heated screw extruders currently used to extrude thermoplastic materials. It is suitable in particular for the production of animal feed, dietary supplements and pharmaceuticals in the form of pellets which often contain substances which are highly sensitive to temperature. Thanks to the process and apparatus disclosed by the present invention, these can be manufactured without significant heating and hence without affecting their properties.

Moreover, the apparatus (20) facilitates plastic deformation to such a great extent that it can be used to pelletize materials (21) to which pelletizing processes according to conventional methods are at present difficult, if not impossible, to apply. It is therefore evident that the invention as described above fully achieves its aims, and, moreover, is simple in construction and, hence, economical.

The invention described can be subject to modifications and variations without thereby departing from the scope of the inventive concept. Moreover, all the details of the invention may be substituted by technically equivalent elements.

In practice, modifications and improvements can be made which fall within the scope of the claims set out hereunder.

What is claimed is:

1. A process for pressing a material selected from the group comprising materials of vegetable and animal origin, comprising:

mechanically compressing the material;

simultaneously vibrating the material at an ultrasonic frequency, whereby the ultrasonic frequency going through the material modifies the material's internal state so as to considerably reduce resistance offered by the material to mechanical compression;

squeezing the material to squeeze out juices contained therein; and tapping the juices squeezed from the material;

wherein the steps are carried out at ambient temperature and without heating, wherein the compressing and vibrating steps are carried out by an actuator that is the same for both the compressing and vibrating steps, wherein the material is contained in a container, wherein the actuator comprises a pressure element connected to an ultrasound generator, and wherein the actuator is mounted so that it can slide inside the container.

2. The process according to claim 1, wherein a hopper, interconnected with the container, feeds the material to the container.

3. The process according to claim 2, wherein the hopper is equipped with a metering valve.

4. The process according to claim 3, wherein the container comprises means attached thereto for tapping the juices squeezed out of the material.

5. The process according to claim 4, wherein the container comprises a wall that can be opened to remove the material after the compressing step.

6. The process according to claim 5, wherein the container comprises an end wall with holes to produce rods of compressed material pressed by the actuator.

7. The process according to claim 6, wherein the end wall comprises means for cutting the rods into pellets when the rods are pressed out through the end wall.

8. A process for pelletizing a material selected from the group comprising animal feeds, dietary supplements and temperature-sensitive pharmaceuticals subject to plastic deformation, comprising:

mechanically compressing the material;

simultaneously vibrating the material at an ultrasonic frequency, whereby the ultrasonic frequency going through the material modifies the material's internal state so as to considerably reduce resistance offered by the material to mechanical compression;

extruding the material to produce rod-shaped segments; and cutting the rod-shaped segments into pellets.

9. The process according to claim 8, wherein the steps are carried out at ambient temperature and without heating.

10. The process according to claim 9, wherein the compressing and vibrating steps are carried out by an actuator that is the same for both the compressing and vibrating steps.

11. The process according to claim 10, wherein the material is contained in a container, wherein the actuator comprises a pressure element connected to an ultrasound generator, and wherein the actuator is mounted so that it can slide inside the container.

12. The process according to claim 11, wherein a hopper, interconnected with the container, feeds the material to the container.

13. The process according to claim 12, wherein the hopper is equipped with a metering valve.

14. The process according to claim 13, wherein the container comprises means attached thereto for tapping the juices squeezed out of the material.

15. The process according to claim 14, wherein the container comprises a wall that can be opened to remove the material after the compressing step.

16. The process according to claim 15, wherein the container comprises an end wall with holes to produce rods of compressed material pressed by the actuator.

17. The process according to claim 16, wherein the end wall comprises means for cutting the rods into pellets when the rods are pressed out through the end wall.

* * * * *